US005297974A

United States Patent [19]

Fussell

[11] Patent Number: 5,297,974

[45] Date of Patent: Mar. 29, 1994

[54] POSITIVELY RELEASED SEISMIC CABLE CONNECTOR

[76] Inventor: Don L. Fussell, 6209 Windfern, Houston, Tex. 77040

[21] Appl. No.: 944,305

[22] Filed: Sep. 14, 1992

[51] Int. Cl.[5] ..... H01R 13/629

[52] U.S. Cl. ..... 439/320; 439/310

[58] Field of Search ..... 439/320, 321, 322, 323, 439/310, 312, 311

[56] References Cited

U.S. PATENT DOCUMENTS

| | | | |
|---|---|---|---|
| 2,312,002 | 2/1943 | Schmitt | 439/320 |
| 2,563,762 | 8/1951 | Uline et al. | 439/320 |
| 3,124,404 | 3/1964 | Chesnov | 439/310 |
| 4,138,182 | 2/1979 | Muratsuka | 439/322 |
| 4,580,865 | 4/1986 | Fryberger | 439/320 |
| 5,046,964 | 9/1991 | Welsh et al. | 439/321 |

*Primary Examiner*—Gary F. Paumen
*Assistant Examiner*—Hien D. Vu
*Attorney, Agent, or Firm*—Bush, Moseley & Riddle

[57] ABSTRACT

In accordance with an illustrative embodiment of the present invention, an electrical connector assembly to connect the end of a seismic cable to a data acquisition unit includes a body member having a plurality of sockets in one end which react with pins on a companion receptacle. A tubular shell which is rotatably mounted on the body member has threads that make up with threads on the receptacle, and a drive ring which engages a shoulder on the body member to force the sockets onto the pins as thread make-up takes place. As the threads are released, the drive ring moves back into engagement with an opposed shoulder on the body member to positively separate the sockets and pins.

5 Claims, 1 Drawing Sheet

POSITIVELY RELEASED SEISMIC CABLE CONNECTOR

FIELD OF THE INVENTION

This invention relates generally to a multi-pin connector used to electrically interconnect data acquisition units to each other in seismic surveying operations, and particularly to a new and improved electrical connector of this type having a positive, axial cam assisted release of the pins on one connector member from the sockets on the other connector member so that damage thereto during disconnection is avoided.

BACKGROUND OF THE INVENTION

When seismic prospecting is done in shallow bays and marshes having, for example, a water depth of up to about 6 ft., a number of data acquisition units (DAUs) which are floated about 50 meters from one another along a survey line having drop cables suspended therefrom which support and connect hydrophones thereto. Waterproof, multi-channel electrical cables extend between adjacent pairs of the DAUs so that the output signals from the hydrophones are transmitted to a recorder on a boat. The DAUs can be individually anchored to the water bottom in a suitable manner. In response to a source of acoustic energy which is created, for example, by the explosion of a charge of dynamite or an air gun in the water to the side of the survey line, the resulting acoustic waves travel down through the earth and are reflected back upward toward the surface when they encounter a boundary between two earth strata which have substantially different acoustic impedances. The arrival of the reflected acoustic waves is detected by the hydrophones, and is transmitted by the DAUs and the cables to the recorder. The survey results can be used to map the contours of the various underwater geological structures which are under the body of water, and particularly when displayed in multi-dimensional form, such maps provide valuable aids in determining those structures which might contain hydrocarbons in commercial quantities.

After the seismic data has been acquired, it is necessary to retrieve from the water all the equipment including the DAUs, the cable sections, and the hydrophones. To make waterproof connections between the ends of the multi-channel cables and the DAUs, it is a common practice to use connector assemblies that are threaded together in some fashion to achieve a fluid-tight seal. When such assemblies are disconnected by a crew member, serious problems have been encountered due to damage to the pins as the connector members are released. After release of the threads, the pins and sockets are still engaged. To achieve their release, it was common practice to rock the connector member which is located at the end of the cable from side-to-side while pulling thereon. The resultant side loading on the ferrules of the pins, which are molded and bonded in place, produced cracks in the bonds. The next time the cable and its end connections were used, salt water can leak in through these cracks and, in short order, destroyed the electrical integrity of the connector.

A general object of the present invention is to provide a new and improved electrical connector of the type described where the pins and sockets are positively released from one another as the threads which hold the connector members together are released.

Another object of the present invention is to provide a new and improved electrical connector of the type described where a shell that surrounds a body has a threaded portion that is coupled to threads of a companion receptacle and which draw the connector members tightly together to ensure a leak-proof connection.

Another object of the present invention is to provide a new and improved electrical connector assembly of the type described where the unthreading of the shell from the receptacle during disconnection provides a positive separation of the sockets and pins during a substantial portion of the travel of the shell that is necessary to unthread it from the companion threads on the receptacle, whereby release of the sockets from the pins then can be accomplished without applying damaging bending loads thereto.

SUMMARY OF THE INVENTION

These and other objects of the present invention are attained in accordance with the concepts of the present invention through the provision of an electrical connector assembly including a body member having a plurality of socket means arranged in a pattern therein, and a receptacle member having a corresponding plurality of pin means mounted therein in the same pattern. A tubular shell member is rotatably mounted on said body member and has an axial cam in the form of a male threaded portion on its forward end that is made up with a companion female threaded portion of the receptacle member. The shell member is movable longitudinally relative to the body between first and second positions. A drive member carried by the shell member engages a first shoulder on the exterior of the body member in the first position to positively drive the sockets over the pins and to achieve a leak-proof engagement. As the shell is rotated in the opposite direction to release the threaded engagement, the shell member moves to the second position where the drive member abuts a second shoulder on the body so that during a final portion of the unthreading rotation of the shell member, the body is driven rearward to positively pull the sockets at least partially off the pins. Since the sockets and pins are substantially disengaged in this manner, they then can be completely disengaged by hand without applying damaging bending loads to the pins. The connector assembly retains its leakproof capability during repeated use, since no fluid leakage paths in the form of cracks are formed as described above, which would otherwise destroy the electrical integrity of the connector.

BRIEF DESCRIPTION OF THE DRAWINGS

The present invention has the foregoing as well as other objects, features and advantages which will become more clearly apparent in connection with the following detailed description of a preferred embodiment, taken in conjunction with the appended drawings in which.

DETAILED DESCRIPTION OF A PREFERRED EMBODIMENT

Figure 1:
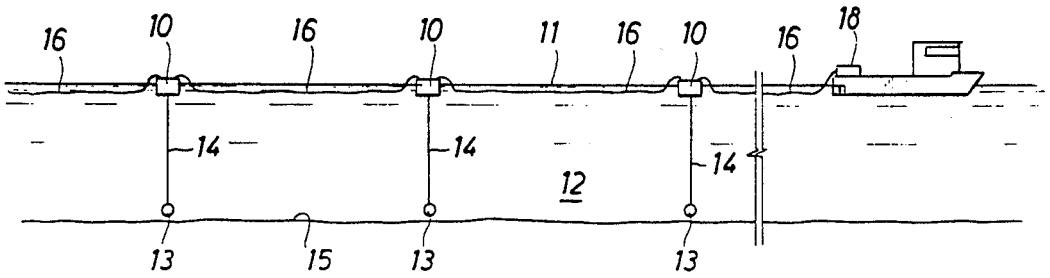
FIG. 1 is a schematic view of a type of seismic survey where the present invention can be used.

Referring initially to FIG. 1, a seismic survey is shown being conducted using a plurality of spaced DAUs 10 which float on the surface 11 of a shallow body of water 12. A hydrophone 13 is suspended from each DAU 10 by a drop line 14 in a manner such that each phone is located near the water bottom 15, or can be implanted therein by means such as a spike on the bottom end of the housing in which the phone is mounted. Suitable means (not shown) such as an anchor having a line tied to each DAU can be used to hold them in a specified position along a survey line. The DAUs 10 can be spaced approximately 50 meters apart, and electrical cables 16 which are connected at their opposite ends by assemblies 18 to an adjacent pair of the units 10 are used to transmit electrical signals representative of the outputs of the hydrophones 13 to a data recorder R onboard a boat B that is stationed at one end of the line. In a typical seismic operation, an acoustic energy source, such as a charge of dynamite, is exploded in the water 12 to one side of the survey line, and the resulting acoustic waves travel downward through the earth below the water bottom 15 and are reflected back upward at levels where they encounter substantial impedance mismatches between layers or strata of rocks. The reflected or upcoming acoustic waves cause the hydrophones 13 to provide output signals, which are acquired by the respective DAUs 10 and then transmitted along the cables 16 to the onboard recorder R.

Figure 2:
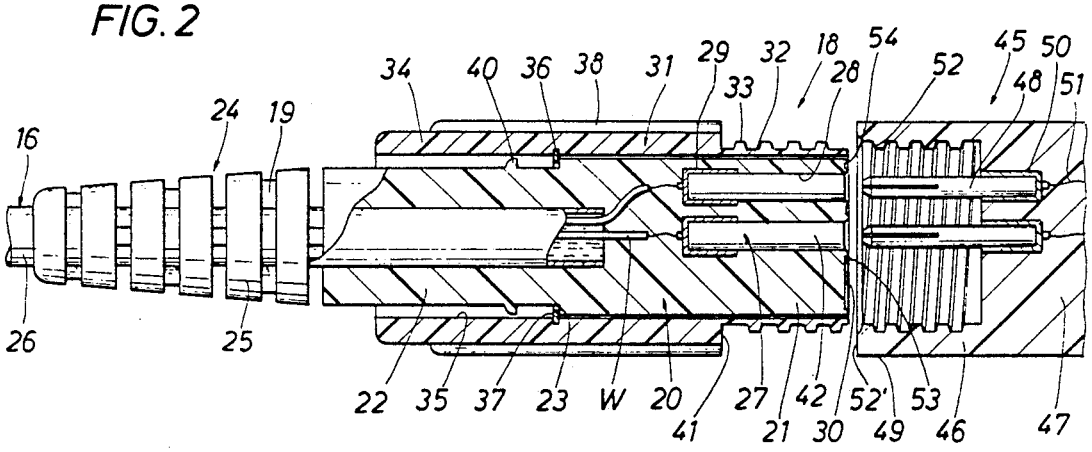
FIG. 2 is a longitudinal cross-sectional view of the present invention.

As shown in FIG. 2, a connector assembly 18, which is constructed in accordance with the present invention, mechanically and electrically connects an end of the cable 16 to one of the DAUs 10. Although the assembly 18 is shown in a horizontal position for convenience of illustration, it can be in a vertical position. The connector assembly 18 includes a generally cylindrical body member 20 that can be made, for example, of a suitable synthetic elastomer. The body member 20 has a larger diameter front portion 21 and a lesser diameter rear portion 22 which form an outwardly facing annular shoulder 23. The rear end of the portion 22 is molded integrally with a stress relief device 24 which can include a conical-shaped series of spaced elastomer rings 25 that are joined by angularly offset longitudinal ribs 25. The end portion 26 of the insulated, multi-conductor cable 16 passes through the device 24 and into, and through, the rear portion 22 of the body member 20. At a location that is preferably beyond the shoulder 23, the conductor wires W in the cable 16 are brought out and attached to conductive metal sleeves 29 at the respective rear ends of a plurality of sockets 27. The sockets 17 are arranged in a certain pattern, such as five outer sockets at an angular spacing of 72° around a center socket. The sockets 27 open to the outside of the front end surface 30 of the body member 20, the bottom socket position being empty so that the pins and sockets can be engaged in only one relative angular position.

Another part of the connector assembly 18 is an elongated tubular shell 31 which preferably is made of a high density plastic material. The shell 18 is rotatably mounted on the body member 20 and has a reduced diameter forward portion 32 that is externally threaded at 33. A larger diameter rear portion 34 spans a substantial portion of the respective lengths of the front and rear portions 21, 22 of the body member 20, and the bore 35 of the sleeve 31 is sized such that it can be easily rotated by hand relative to the body member 20. Longitudinal ribs 38 can be provided on the shell 31 as an aid to fuming. At a point approximately mid-way of the length of the rear portion 34 of the shell 31, an internal annular groove 36 is formed which extends radially outward. The groove 36 receives a drive ring 37 that can be, for example, a metal spiral-lock ring. The ring 37 can be inserted into the bore 35 in a retracted condition, and then allowed to expand so that it is captured in the groove 36. The inner diameter of the ring 37 is only slightly greater than the outer diameter of the external surface 39 of the body member 20 that extends between the shoulder 23 and a second, forwardly facing shoulder 40 that is formed at a selected distance to the rear of the front shoulder 23. In a preferred form, the outer side of the rear shoulder 40 is generally circular to provide a transition surface over which the drive ring 37 can be expanded as the shell 31 is positioned on the body member 20 during assembly.

The longitudinal spacing between the rear shoulder 40 at the shoulder 23 provides for lost-motion which occurs between the shell 31 and the body 20 during an initial portion of the unthreading of the threads 33 during release. However, once the drive ring 37 engages the rear shoulder 40, further unthreading positively pulls the body member 20 and the sockets 28 rearward with the shell 31.

The overall configuration of the female receptacle or socket 45 also is shown in FIG. 2. The to receptacle 45, which is mounted on the case of a DAU 10, includes a tubular member 46 which is formed integrally with, and extends outwardly from, a base portion 47 which mounts a plurality of connector pins 48. The inner end of each pin 48 is received in a ferrule 50 which is embedded in the base 47 and the pins 48 are arranged in the same pattern as the sockets 27. A conductor wire 51 is soldered to the rear side of each ferrule 50 to electrically connect to the respective pins 48 to circuits within a DAU 10.

The tubular member 46 has threads 52 formed internally thereof which match the external threads 33 on the forward end portion 32 of the shell 31. As the threads 52 and 33 are progressively engaged by right hand rotation of the shell 3 1, the drive ring 37 abuts the shoulder 23 on the body 20 and forces the sockets 28 to telescope over the pins 48 as the front portion 21 of the body 20 is advanced into the tubular member 46. At the end of relative forward movement of the body member 21 and the shell 31, the outwardly projecting seal lips 53 around the openings of the sockets 28, and another lip 54 around the outer edge of the front face 30, forcefully engage companion elements on the rear wall 53 of the receptacle 46 to provide a leak-proof connection. The front face 41 of the shell 31 is spaced with respect to the front shoulder 23 such that when the threads 33 and 52 are made up hand tight, the face 41 is up against the end face 52 of the receptacle 46.

OPERATION

In operation, the male connector member 18, constructed and assembled as shown in FIG. 2, is coupled to the female receptacle 45 by pushing the outer portions of the sockets 28 onto the pins 48 until the outer end of the threads 33 come up against the outer sides of the threads 52. At this point the drive ring 37 will be positioned up against the shoulder 23 as shown in phantom lines in FIG. 3, so that rotation of the shell 31 to the right will begin to make up the threads 33 and 52. As make up occurs, the drive ring 37 positively forces the body member 20 to follow the shell 31, so that the sockets 27 are advanced fully over the pins 48. At full engagement the outwardly facing shoulder 41 on the shell 31 butts up against the opposed end face 49 on the tubular portion 45. The outwardly extending seal lips 53 and 54 are forced against cooperating surfaces on the end wall of connector member 45 to provide leak-proof seals against water entry.

Figure 3:
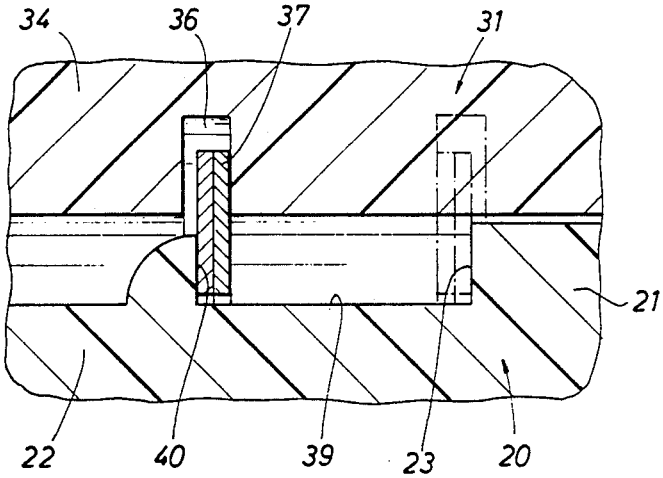
FIG. 3 is an enlarged, fragmentary sectional view showing the drive ring assembly that achieves positive engaging and releasing actions.

When it is necessary to disconnect the end of a cable 16 from a DAU 10, the shell 31 is rotated by hand relative to the body member 20 in the counterclockwise direction. The threads 33 and 52 cooperate to cam the shell 31 rearward over an initial lost-motion distance until the drive ring 37 bears against the rear shoulder 40 as shown in FIG. 3. Further turning of the shell 31 positively jacks or drives the body member 20 rearward with respect to the connector member 45 to further pull the sockets 27 off the pins 46. When the threads 33 and 52 are completely disengaged, the sockets 28 have only a short length of engagement with the pins 48. The body member 21 and the shell 31 then can be pulled rearward a short distance to achieve full disengagement of the sockets 28 from the pins 48 without having to apply any back-and-forth wobbling or bending moments, which otherwise result in side loading of the pins that produce cracks in the bonds.

It now will be recognized that a new and improved connector assembly that meets the objects of the present invention, and which has each of the features and advantages noted above, has been disclosed. Since certain changes or modifications may be made in the disclosed embodiment without departing from the inventive concepts involved, it is the aim of the appended claims to cover all such changes and modifications that fall within the true spirit and scope of the present invention.

What is claimed is:

1. In an electrical connector assembly having a pair of connector body members with confronting end faces, said members having pin and socket means for making electrical connections, one of said members having first axial cam means, comprising: tubular means rotatably mounted on the other of said body members and having second axial cam means cooperable with said first axial cam means to force said tubular means axially toward said one body member in response to relative rotation in one hand direction to engage said socket and pin means; coengageable first drive means on said tubular means and said other body member for pushing said other body member axially toward said one body member to cause engagement of said pin and socket means with one another and to forcefully engage said confronting faces in response to said relative rotation, said first drive means including a rearwardly facing shoulder on said other body member, an internal radial groove in said tubular means, and a drive ring mounted partially in said groove and arranged to engage said shoulder; coengageable second drive means on said tubular means and said other body member for pulling said other body member away from said one body member to at least partially release said pin and socket means in response to relative rotation in the opposite hand direction; and means forming a lost-motion coupling in connection with said first and second drive means to allow partial release of said axial cam means before the said pulling of said other body member away from said one body member begins.

2. The assembly of claim 1 wherein said shoulder is formed at the intersection of a greater diameter portion of said other member and a lesser diameter portion thereof.

3. An electrical connector assembly adapted for use in seismic operation to connect the end of a multi-conductor cable to a data acquisition unit, comprising: a cylindrical body member having a plurality of sockets therein which open through the outer face thereof; a receptacle member including a base having a corresponding plurality of pins mounted thereon which are adapted to mate with said sockets, said base having a tubular portion which surrounds said pins; an elongated tubular shell rotatably mounted on said body member and movable longitudinally relative thereto between first and second positions, said shell having a reduced diameter front end portion; axial cam means on said front end portion and said tubular portion for forcing said portions into telescoping engagement in response to relative rotation in one hand direction; first drive means including a drive ring within said shell engageable with a first shoulder on said body member and operable in said first position for causing said body member to move axially with said shell toward said receptacle to engage said sockets with said pins; and second drive means including said drive ring and a second shoulder on said body member to move axially with said shell away from said receptacle to at least partially disengage said sockets from said pins, said shoulder being axially spaced to provide lost-motion axial movement of said shell relative to said body means between engagement of said first and second drive means.

4. The assembly of claim 3 wherein said lost-motion is provided by an axial separation of said shoulders by a distance which is substantially greater than the thickness of said drive ring.

5. The assembly of claim 3 wherein said axial cam means are threads.

* * * * *